US006305322B1

(12) United States Patent
Patel

(10) Patent No.: US 6,305,322 B1
(45) Date of Patent: Oct. 23, 2001

(54) PICKUP DEVICE FOR ANIMAL WASTE

(75) Inventor: Tony Patel, 3204 12th St. W., Lehigh Acres, FL (US) 33971

(73) Assignee: Tony Patel, Naples, FL (US)

( * ) Notice: Subject to any disclaimer, the term of this patent is extended or adjusted under 35 U.S.C. 154(b) by 0 days.

(21) Appl. No.: 09/512,624

(22) Filed: Feb. 25, 2000

(51) Int. Cl.[7] ..... A01K 29/00
(52) U.S. Cl. ..... 119/161; 294/1.4
(58) Field of Search ..... 119/161; 294/1.3–1.5

(56) References Cited

U.S. PATENT DOCUMENTS

| | | | | |
|---|---|---|---|---|
| 3,444,938 | * | 5/1969 | Ballmann | 111/101 |
| 3,819,220 | * | 6/1974 | Bredt | 294/1.3 |
| 4,078,838 | * | 3/1978 | Nadratowski | 294/1.3 |
| 4,200,319 | * | 4/1980 | Cooper | 294/1.3 |
| 4,225,169 | * | 9/1980 | DeToma | 394/1.3 |
| 4,466,647 | * | 8/1984 | Spevak | 294/1.3 |
| 5,344,200 | * | 9/1994 | Yoshioka | 294/1.5 |

FOREIGN PATENT DOCUMENTS

| | | | | |
|---|---|---|---|---|
| 406033429 | * | 2/1994 | (JP) | 394/1.3 |

* cited by examiner

*Primary Examiner*—Peter M. Poon
*Assistant Examiner*—Son T. Nguyen

(57) ABSTRACT

The invention discloses a device for picking up animal waste. The device is an elongated outer tubular handle having an interior manipulator therein. At end of the outer handle there is located a hollow tubular casing. At an outer end of the inner manipulator is located a handle and at the other end there is separably located a claw or a cross made of stiff but flexible material. The claw has four arms. The circumference of the claw is substantially larger than an inner diameter of the hollow tubular casing. Thereby, when the claw is pulled inwardly of the hollow tubular casing, the claws will collapse within the hollow tubular casing. Thereby, any animal waste can by picked up and deposited in a convenient location. Before picking up the waste, a piece of paper or bag is placed within the claw. This results in that no waste is exposed to any elements of the pick-up device including the arms of the claw.

13 Claims, 3 Drawing Sheets

PICKUP DEVICE FOR ANIMAL WASTE

BACKGROUND OF THE INVENTION

The invention pertains to an animal waste pickup device that can be used in an easy procedure and in a completely sanitary manner. Pet owners and other observers are quite familiar with city and other local ordinances that require pet owners, who take their pets for walks, to pick up the pet's or animal's dropping such as feces to keep the environment in a sanitary condition. This ordinance, including common sense, applies to public properties as well as private properties. With the increased public concern over sanitation and a cleaner environment many municipalities have required that dog owners clean up after the animals have defecated on public properties. Although this is more pleasant for the public, it leaves the dog owner with an extremely unpleasant task. Many different scooping devices have been provided to hold a bag open while the feces are scraped or scooped therein. Various devices are known to accomplish the above mandate. It is known to use plastic gloves that are worn on the hand which simply pick up the droppings and by inverting the glove or by stripping the glove off the hand to invert the same, the dropping can be disposed of in a sanitary manner. Others simply carry a small shovel and a bucket or similar container to accomplish the same task as noted above. Then, there are other more complicated devices which accomplish the pick up and disposal of animal droppings in a completely sanitary manner.

U.S. Pat. No. 4,097,082 describes a device which accomplishes the above noted task. The implement described in the above noted patent consists of an elastomeric band to automatically close over the mouth of a flexible wrapper which is operated by two side plates that will swing inwardly at their bottoms to thereby grab the flexible wrapper having the animal dropping therein, to keep it therein and to thereafter dispose of the same, all in a sanitary manner.

U.S. Pat. No. 5,628,537 shows a similar device. This patent discloses a device which also uses a pair of jaws that are pivotally attached to one end of a long handle. An elongated sleeve is connected to the jaws around the handle. When the jaws are locked open, a bag clip engages the closed end of an ordinary thin plastic bag while the open end of the bag is everted over the edges of the jaws. To pick up the dog feces, the user positions the open bag over the waste, makes jaw contact with the ground, rotates the sleeve to unlock a sliding motion and moves the sleeve downward on the handle. This closes the jaws and encloses the waste within the bag to be disposed of at a later time and in a sanitary manner.

OBJECTS OF THE INVENTION

An object of the invention at hand is to simplify the above noted task of picking up the animal droppings or feces and to dispose of the same in a completely sanitary manner. To this end, the device of the invention operates in a very simple and effective way. It is a lightweight portable device which is easily carried by the user in one hand while being able to control the animal on a leash with the other hand. The device is then activated, with one hand, picking up the feces, bagging and releasing the sealed bag with the waste inside and then dispose of the bag in an appropriate location. Any parts of the device do not come into direct contact with the dog droppings or feces. The device includes a claw and when the claw is activated, the bag performs the function of shielding the claw mechanism from the waste. The device consists of a hollow tube that contains a rod running through the tube and it has a handle on one end and a scooping claw mechanism on the other end. On the rod end closest to the claw, a spring is attached that allows for the automatic retraction of the claw when the handle is released in a controlled manner. The hollow tube on the claw end of the inventive device has a cylinder attached to the same with a bag attached which the claw collapses and triggers the bag to seal.

DETAILED DESCRIPTION OF THE INVENTION

Figure 1:
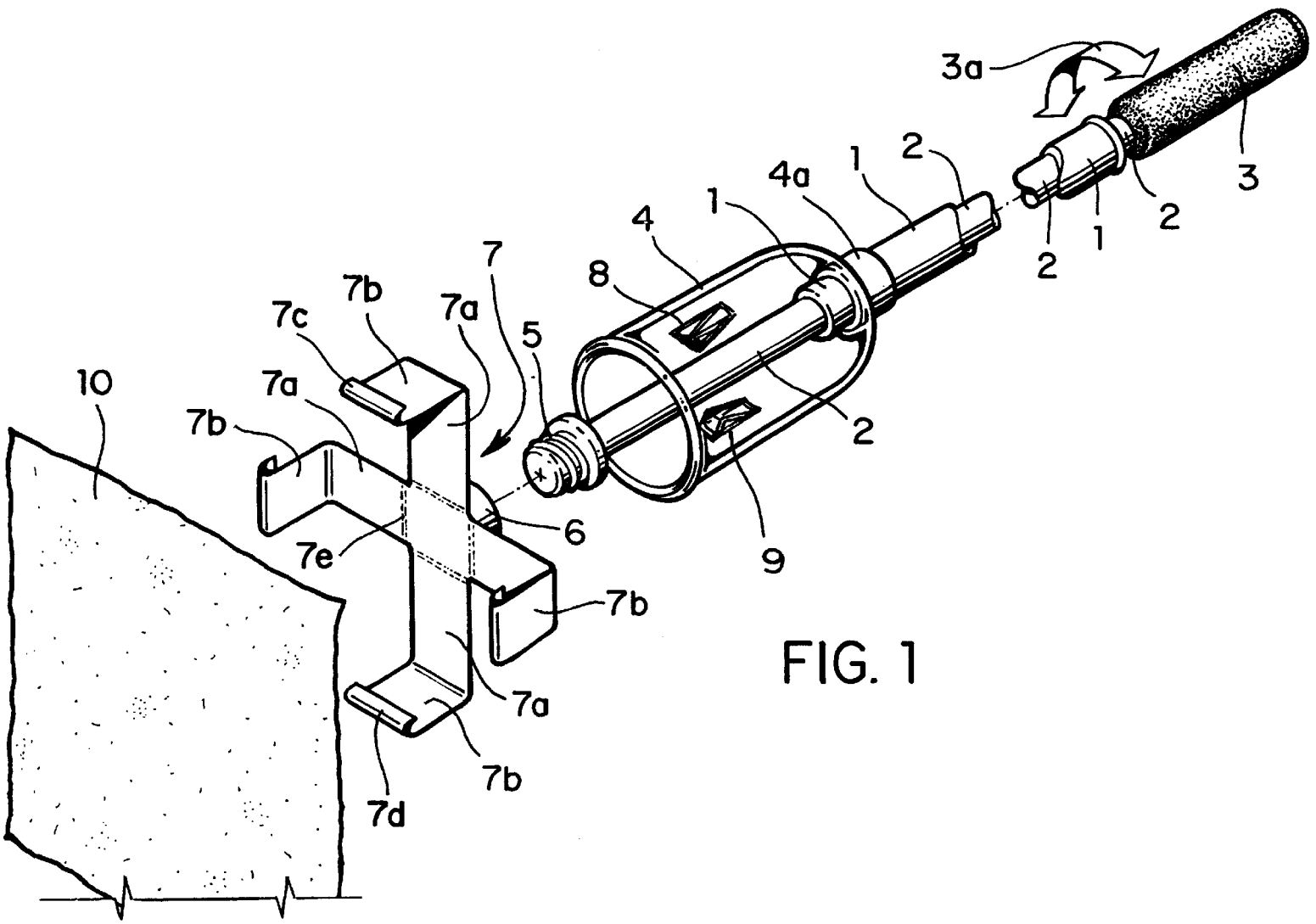
FIG. 1 is a perspective view of the device in an open position.

FIG. 1 shows in detail the inventive animal waste pick-up device in a perspective view. The device includes a tubular exterior pole 1 which is being held in one hand when the device is operated in its intended use. Within handle 1 slides a second rod or manipulator 2 which at its rear end has a pole 3 mounted thereon which can be rotated as shown by the arrow 3*a* and the purpose of which will be explained below. The forward end of pole 2 has a sleeve 4*a* mounted thereon which receives a hollow tube-shaped receptacle 4 which is connected to the sleeve 4*a*. The forward end of the rod 2 has a threaded bushing 5 fastened thereto. The bushing 6 has interior threads that match the exterior threads of the sleeve 5. Attached to the bushing 6 is a scooping claw 7 made out of a thin flexible plastic material such as a clear or opaque acetate. The scooper claw consists of a collapsible cross having four arms 7*a*. Each of the arms 7*a* has bent over ends 7*b* which are long enough so that they overlap each other when the collapsible scooper claw 7 is collapsed as will be explained below. The outer circumference of the claw, when laid out flat, is substantially larger than the inner diameter of the hollow tube 4. The outer ends of the bent over ends 7*b* have reversed and curved formations 7*c* and 7*d*, respectively. These curved and reversed formations 7*c* and 7*d* will interlock with each other when opposing arms 7*a* of the claw 7 approach each other and then move into a final locked position. The scooper claw 7 has folding lines 7*e* impressed into its material to aid the collapse of the scooper claw or cross when it is activated.

Figure 2:
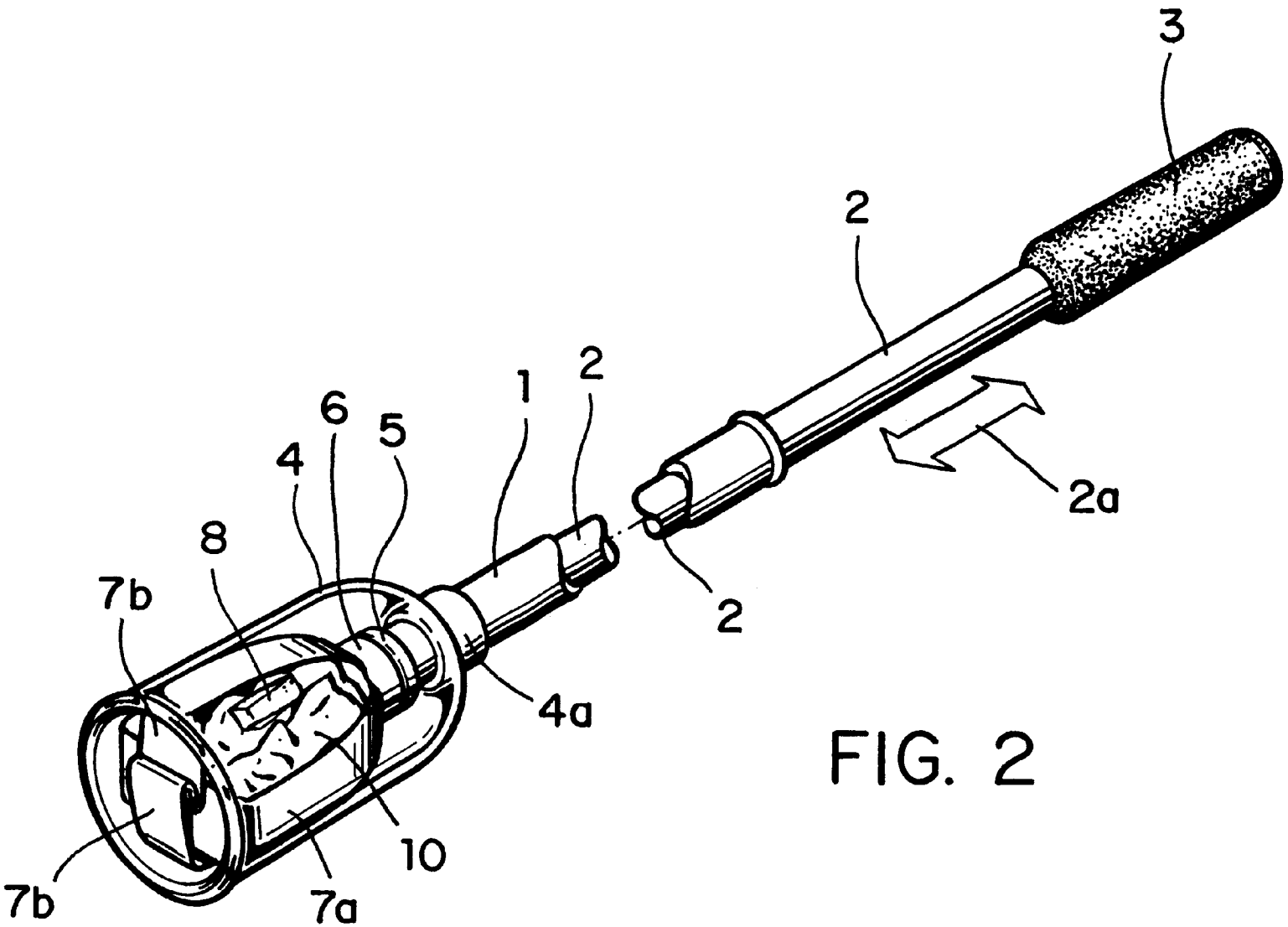
FIG. 2 is a perspective view of the device of FIG. 1 in a closed position.

FIG. 2 shows the device of FIG. 1 in an activated position. The same reference characters have been applied to the same elements as are shown in FIG. 1. The operation of the waste pick-up device is as follows:

In normal use the scooper claw 7 is attached to the interior rod 2 by way of the threads located on the exterior of the sleeve 5 and the interior threads located in the bushing 6. A piece of paper or bag 10 is placed into the claw or cross 7 prior to using the device. If animal waste is now to be picked up, the user of this device has to merely position the claw 7 with the paper or bag thereon over the waste and to pull up on handle or tube 1. By doing so, the claw is pulled into the interior of the hollow tube 4 whereby the arms 7*a* of the claw 7 will collapse toward each other with the aid of the fold lines 7*e* while at the same time scraping up the waste from the ground. The collapse of the claw is also aided by the fact that the circumference of the claw, when laid out flat, is substantially larger than the inner diameter of the hollow tube 4. Once the rod 2 has been pulled into the tubular pole far enough, the arms 7*a* of the claw 7 have completely been collapsed inside the hollow tube 4 to completely encircle the waste within the arms 7*a*. At this point the paper or bag 10 will have completely surrounded the waste within the arms 7*a* of the claw 7 without the waste ever having touched the arms 7*a* of the claw 7 or any other elements of the device.

Figure 3:
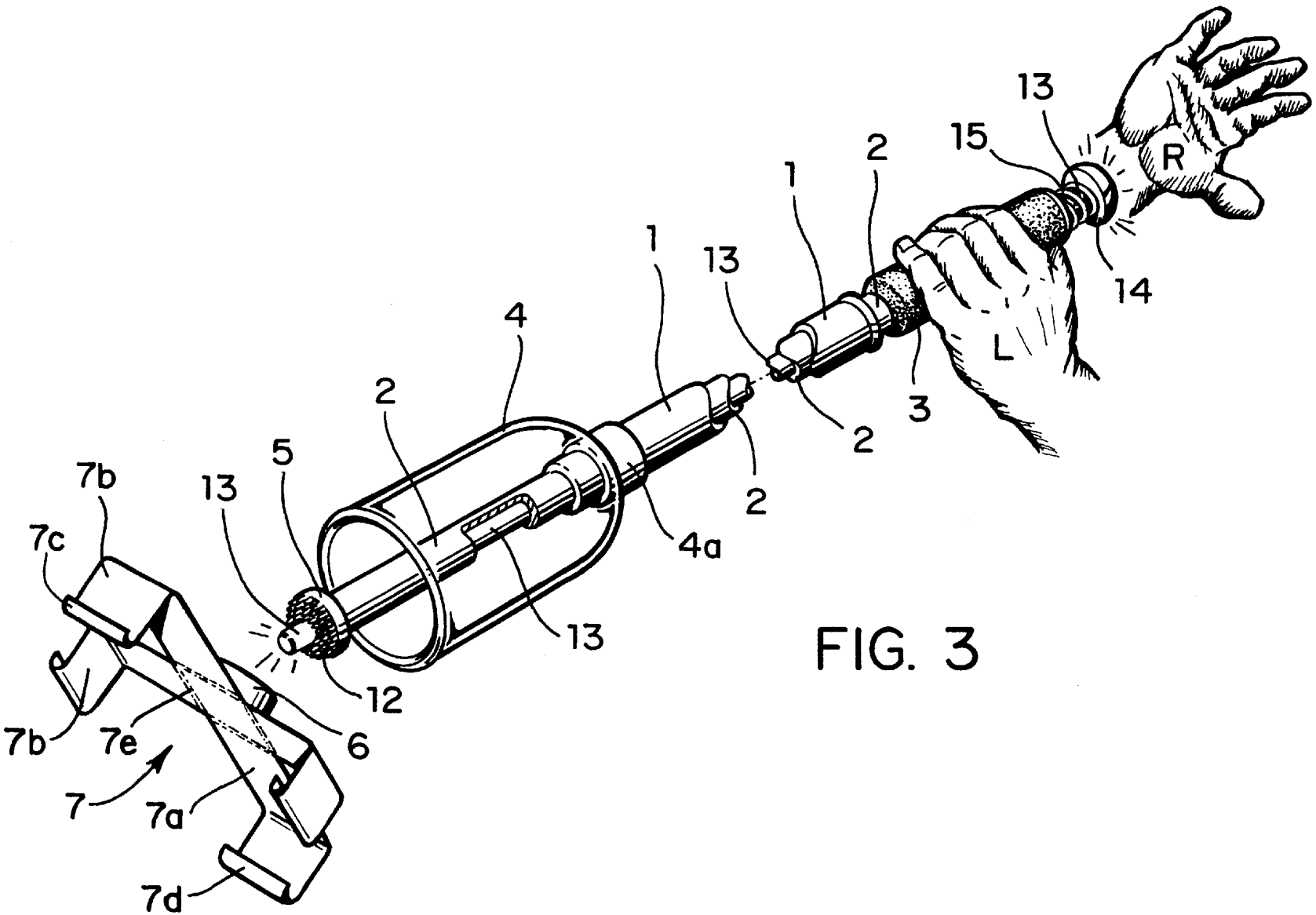
FIG. 3 is a perspective view of the device of FIGS. 1 and 2 having a different ejector mechanism.

Turning now to FIG. 3, there is shown a somewhat different embodiment of the animal waste pick-up device. The same reference characters are applied to the same elements as shown in FIGS. 1 and 2. In this embodiment the screw threads of the sleeve 5 and the bushing 6 have been replaced by either VELCRO™ or by magnets 12. These elements are known for their quick release characteristics and their repeated use capabilities. The loop and hook fasteners of the VELRO™ are each placed on the sleeve 5 and the bushing 6, respectively. In the same manner the opposing magnetic poles of the magnets are similarly placed. In this way the claw 7 is simply and quickly attached to the interior manipulator tube 2 by way of the bushing 6 and the sleeve 5. Located within the manipulator tube is another inner rod 13 which has a knob 14 attached at an outer end while the other end protrudes from the end of the sleeve 5. However, the end of the inner rod is prevented from freely protruding from the sleeve 5 by a spring 15 which is placed between the outer handle 3 and the knob 14 so that the inner rod is always biased outwardly. Once the waste pick-up device has been manipulated, as was explained with reference to FIGS. 1 and 2, and one is desirous of dropping the picked up waste at a certain location, one has to merely hit the knob 14, as is shown in FIG. 4, and the claw together with its waste is being ejected from the hollow tube 4 because the hitting force on the knob 14 will easily separate the hook and loop fasteners from each other. Thereafter, the inner rod immediately returns to its rest position by way of the spring 15 and the interior manipulator rod can again be used with a replacement claw and a paper bag thereon. In FIG. 3 there is shown a right hand R and a left hand L which manipulate the knob by simply hitting it. Of course, a left handed person would reverse the hands.

Also shown in both FIGS. 1 and 2 are rotation prevention stops 8 and 9. The stops 8 and 9 are pressed into the material of the hollow receptacle 4. Therefore, when the arms 7*a* of the scooper claw are collapsed within the hollow receptacle 4, the arms 7*a* will abut against the stops 8 and 9 to prevent any rotation of the arms 7*a*. Thereby, the rod 2 with its bushing 5 can be unscrewed from the sleeve 6 and the scooper claw 7 can drop out of the receptacle 4.

What I claim is:

1. An animal waste pick-up device comprising an elongated exterior tubular pole having a hollow tube mounted at one end thereof and rigidly attached thereto, an interior manipulator rod is slidingly movable within said exterior tubular pole, said manipulator rod has at one end thereof a manipulator handle thereon and at another end of said manipulator rod has a sleeve attached thereto, means for separably attaching said manipulator rod to a scooper claw of plastic material having four arms attached thereto including a bushing, said scooper claw has a circumference which is substantially larger, when laid out flat, than the inner diameter of said hollow tube, whereby, when said interior manipulator rod is pulled into said tubular pole, the arms of said scooper claw will collapse into said hollow tube while at the same time scraping said waste from a surface of the ground.

2. The animal waste pick-up device of claim 1, wherein each end of the arms of said claw has a bent section, which section is bent at a substantially right angle relative to its respective arm.

3. The animal waste pick-up device of claim 2, wherein an end of said bent section has a locking formation thereon so that opposed arms with their respective bent sections can interlock with each other.

4. The animal waste pick-up device of claim 1, wherein said means for separably attaching includes screw threads on both said sleeve and said bushing.

5. The animal waste pick-up device of claim 1, wherein said means for separably attaching includes loop and hook fasteners.

6. The animal waste pick-up device of claim 1, wherein said means for separably attaching includes magnets.

7. The animal waste pick-up device of claim 1 including rotation prevention means for preventing a rotation between said arms of said claw and said hollow tube.

8. The animal waste pick-up device of claim 1 including a means for ejecting said claw from said interior manipulator.

9. The animal waste pick-up device of claim 8, wherein said means for ejecting comprises an elongated rod located within said interior manipulator.

10. The animal waste pick-up device of claim 9 including a knob located at an outer end of said elongated rod for activating said ejector rod.

11. The animal waste pick-up device of claim 10 including a spring located between said manipulator handle and said knob for biasing said ejector rod outwardly of said manipulator handle.

12. The animal waste pick-up device of claim 1 including a waste paper located within said claw.

13. The animal waste pick-up device of claim 12, wherein said waste paper completely encloses said waste within said scooper claw.

* * * * *